US007995018B2

(12) United States Patent
Ooishi et al.

(10) Patent No.: US 7,995,018 B2
(45) Date of Patent: Aug. 9, 2011

(54) DISPLAY DEVICE

(75) Inventors: Yoshihisa Ooishi, Yokohama (JP); Junichi Maruyama, Yokohama (JP); Takashi Shoji, Fujisawa (JP); Kikuo Ono, Mobara (JP)

(73) Assignee: Hitachi Displays, Ltd., Chiba (JP)

( * ) Notice: Subject to any disclaimer, the term of this patent is extended or adjusted under 35 U.S.C. 154(b) by 846 days.

(21) Appl. No.: 11/877,899

(22) Filed: Oct. 24, 2007

(65) Prior Publication Data

US 2008/0238848 A1 Oct. 2, 2008

(30) Foreign Application Priority Data

Oct. 27, 2006 (JP) ..... 2006-292475

(51) Int. Cl.
*G09G 3/36* (2006.01)

(52) U.S. Cl. ..... 345/88; 345/204

(58) Field of Classification Search ..... 345/87–103, 345/204, 690

See application file for complete search history.

(56) References Cited

U.S. PATENT DOCUMENTS

2003/0210256 A1* 11/2003 Mori et al. ..... 345/690
2004/0100433 A1* 5/2004 Ham ..... 345/89
2004/0155847 A1 8/2004 Taoka et al.

OTHER PUBLICATIONS

Taiichiro Kurita, 'Moving Picture Quality Improvement for Hold-type AM-LCDs', SID 01 Digest, 2001.

* cited by examiner

*Primary Examiner* — Stephen G Sherman
(74) *Attorney, Agent, or Firm* — Antonelli, Terry, Stout & Kraus, LLP.

(57) ABSTRACT

A hold-type display device reduces the blur of a moving image and makes less conspicuous the color shift caused due to different blur positions among RGB. In the case where the relative brightness of the video data of one or two of the three primary colors RGB changes from between 0 and 0.5 inclusive for the previous frame to between 0 and 0.5 inclusive for the present frame, the video image of the one or two colors is delayed by one frame and displayed.

7 Claims, 10 Drawing Sheets

DnwX > DprX FOR ALL RGB

| No. | SELF COLOR | 1ST OTHER COLOR | 2ND OTHER COLOR | SELF-COLOR SELECTION | |
|---|---|---|---|---|---|
| | | | | 1st FIELD | 2nd FIELD |
| 1 | AREA A | AREA A | AREA A | DchX=DnwX | |
| 2 | | | AREA B | DchX=DprX | |
| 3 | | | AREA C | | |
| 4 | | AREA B | AREA B | | |
| 5 | | | AREA C | | |
| 6 | | AREA C | AREA C | | |
| 7 | AREA B | AREA B | AREA B | DchX=DnwX | |
| 8 | | | AREA C | | |
| 9 | | AREA C | AREA C | | |
| 10 | AREA C | AREA C | AREA C | | |

MOVING IMAGE BLUR AREA

| | | PRESENT-FRAME RELATIVE BRIGHTNESS | | | | |
|---|---|---|---|---|---|---|
| | | 0.00 | 0.25 | 0.50 | 0.75 | 1.00 |
| PREVIOUS-FRAME RELATIVE BRIGHTNESS | 0.00 | AREA A | | | AREA B | |
| | 0.25 | | | | | |
| | 0.50 | AREA B | | | AREA C | |
| | 0.75 | | | | | |
| | 1.00 | | | | | |

FIG.5A

DnwX > DprX FOR ALL RGB

<table>
<tr><th rowspan="2">No.</th><th rowspan="2">SELF COLOR</th><th rowspan="2">1ST OTHER COLOR</th><th rowspan="2">2ND OTHER COLOR</th><th colspan="2">SELF-COLOR SELECTION</th></tr>
<tr><th>1st FIELD</th><th>2nd FIELD</th></tr>
<tr><td>1</td><td rowspan="6">AREA A</td><td rowspan="3">AREA A</td><td>AREA A</td><td colspan="2">DchX=DnwX</td></tr>
<tr><td>2</td><td>AREA B</td><td colspan="2" rowspan="5">DchX=DprX</td></tr>
<tr><td>3</td><td>AREA C</td></tr>
<tr><td>4</td><td rowspan="2">AREA B</td><td>AREA B</td></tr>
<tr><td>5</td><td>AREA C</td></tr>
<tr><td>6</td><td>AREA C</td><td>AREA C</td></tr>
<tr><td>7</td><td rowspan="3">AREA B</td><td rowspan="2">AREA B</td><td>AREA B</td><td colspan="2" rowspan="4">DchX=DnwX</td></tr>
<tr><td>8</td><td>AREA C</td></tr>
<tr><td>9</td><td>AREA C</td><td>AREA C</td></tr>
<tr><td>10</td><td>AREA C</td><td>AREA C</td><td>AREA C</td></tr>
</table>

FIG.5B

MISCELLANEOUS CASES

<table>
<tr><th rowspan="2">No.</th><th rowspan="2">SELF COLOR</th><th rowspan="2">1ST OTHER COLOR</th><th rowspan="2">2ND OTHER COLOR</th><th colspan="2">SELF-COLOR SELECTION</th></tr>
<tr><th>1st FIELD</th><th>2nd FIELD</th></tr>
<tr><td>1</td><td>—</td><td>—</td><td>—</td><td colspan="2">DchX=DnwX</td></tr>
</table>

FIG.10A

MOVING IMAGE BLUR OFFSET PERIOD Ta

| | | PRESENT-FRAME RELATIVE BRIGHTNESS | | | | |
|---|---|---|---|---|---|---|
| | | 0.00 | 0.25 | 0.50 | 0.75 | 1.00 |
| PREVIOUS-FRAME RELATIVE BRIGHTNESS | 0.00 | | 0.05 | 0.05 | 0.08 | 0.10 |
| | 0.25 | 0.05 | | 0.05 | 0.10 | 0.15 |
| | 0.50 | 0.05 | 0.05 | | 0.55 | 0.55 |
| | 0.75 | 0.08 | 0.10 | 0.55 | | 0.55 |
| | 1.00 | 0.10 | 0.15 | 0.55 | 0.55 | |

FIG.10B

MOVING IMAGE BLUR TIME Tb

| | | PRESENT-FRAME RELATIVE BRIGHTNESS | | | | |
|---|---|---|---|---|---|---|
| | | 0.00 | 0.25 | 0.50 | 0.75 | 1.00 |
| PREVIOUS-FRAME RELATIVE BRIGHTNESS | 0.00 | | 0.40 | 0.40 | 0.78 | 0.80 |
| | 0.25 | 0.40 | | 0.40 | 0.80 | 0.78 |
| | 0.50 | 0.40 | 0.40 | | 0.40 | 0.40 |
| | 0.75 | 0.78 | 0.80 | 0.40 | | 0.40 |
| | 1.00 | 0.80 | 0.78 | 0.40 | 0.40 | |

DISPLAY DEVICE

CLAIM OF PRIORITY

The present application claims priority from Japanese application serial no. 2006-292475 filed on Oct. 27, 2006, the content of which is hereby incorporated by reference into this application.

BACKGROUND OF THE INVENTION

This invention relates to a display device with high moving image quality by suppressing the coloring phenomenon generated in the edge area of an image when scrolled in the black insertion driving.

The display, from the viewpoint of the moving image in particular, can be roughly classified into an impulse-type display and a hold-type display. In the impulse-type display, the brightness response is reduced immediately after scanning like the persistence characteristic of the CRT, while the hold-type display, like the liquid crystal display, continues to hold the brightness based on the display data to the next scan.

The feature of the hold-type display is that a superior display quality free of a flicker can be obtained for a still image. For the moving image, however, the display quality is extremely reduced by the moving image blur in which the edge portion of a moving object blurs in appearance.

This moving image blur is caused by the retinal after-image on the part of the observer who interpolates the display image before and after the movement of the display image with the brightness held while moving the line of sight with the movement of an object. Regardless of how the response speed of display is improved, therefore, the moving image blur is known not to be completely eliminated. An effective method known to overcome this problem is described in "Moving Picture Quality Improvement for Hold-type AM-LCDs, Taiichiro Kurita, SID 01 DIGEST", in which the display image is updated with a shorter frequency or a black screen is inserted thereby to cancel the retinal after-image provisionally in the same manner as in the impulse-type display.

A typical display displaying the moving image is a TV receiver, of which the scanning frequency is standardized at 60 Hz for interlaced scanning in the NTSC signal or 50 Hz for sequential scanning in the PAL signal. In the case where the frame frequency of the display image generated based on this frequency is 60 Hz or 50 Hz, the frequency is not sufficiently high and the moving image blurs.

As a means for improving this moving image blur, US 2004/0155847A (JP-A-2004-240317) discloses a drive method in which one video signal is driven by a double or higher frame frequency and the desired brightness is obtained by combining the brightness of a plurality of frames thereby to realize the effect of black insertion without reducing the brightness.

SUMMARY OF THE INVENTION

In an application of the technique disclosed in US 2004/0155847A (JP-A-2004-240317), the moving image blurs at a different position in accordance with a moving object and the background color. As a result, both the edge area of the moving object and the background area may be observed in different colors.

This coloring mechanism is explained with reference to FIGS. 9 to 11. FIG. 9A shows an instantaneous brightness response waveform with the abscissa representing the frame time t and the ordinate the relative brightness b(t) having a maximum value of 1 and a minimum value of 0. For simplicity, the display response speed is assumed to be 0, and the display brightness is assumed to change before and after the frame time t is 0. In this case, the relative brightness b(t) is expressed by Equation (1) below, where T generally designates one frame period of 16.6 ms.

$$b(t) = \begin{cases} X1 & (-1.0T \leqq t < -0.5T) \\ X2 & (-0.5T \leqq t < 0) \\ Y1 & (0 \leqq t < 0.5T) \\ Y2 & (0.5T \leqq t < 1.0T) \end{cases} \quad (1)$$

FIG. 9B, on the other hand, shows the visual brightness B(t) observed by the man taking the retinal after-image into consideration. The visual brightness B(t) is an integration of the brightness for one frame period, and therefore, can be expressed by Equation (2) shown below.

$$B(t) = \begin{cases} 0.5X1 + 0.5X2 & (t < 0) \\ (0.5T - t)X1 + 0.5X2 + tY1 & (0 \leqq t < 0.5T) \\ (1.0T - t)X2 + 0.5Y1 + (t - 0.5T)Y2 & (0.5T \leqq t < 1.0T) \\ 0.5Y1 + 0.5Y2 & (1.0T \leqq t) \end{cases} \quad (2)$$

As a result, the brightness characteristic is obtained in which the brightnesses obtained at the frame times 0, 0.5T and 1.0T are connected by straight lines as shown in FIG. 9B.

In FIG. 9B, assuming that the brightness at the frame time 0 changing in visual brightness is 0 and the brightness after the lapse of a sufficient time is 1, the period before the relative brightness becomes 0.1 from the frame time 0 is defined as the moving image blur offset period Ta, and the period before the relative brightness changes from 0.1 to 0.9 as the moving image blur time Tb. The moving image blur offset period Ta corresponds to the position at which the brightness changes with the movement of the image, and the moving image blur time Tb corresponds to the width during which the image actually appears to blur. The value Tb is generally defined as MPRT (Moving Picture Response Time).

Assume that the brightness before the frame time 0 is defined as the previous-frame relative brightness and the brightness after the frame time 0 as the present-frame relative brightness. The relation between the moving image blur offset period Ta and the moving image blur time Tb is represented by the characteristics shown in FIGS. 10A, 10B, in which the moving image blur offset period Ta and the moving image blur time Tb change with the brightness of the video data.

In FIGS. 10A, 10B, the moving image blur offset period Ta and the moving image blur time Tb are both preferably as short as possible. In the case where the achromatic color changes only in brightness, the delay of Ta is not recognized by the observer, and the value Tb is considered to be improved as it is smaller than that of the conventional hold-type display in the prior art.

In the display device, the desired color is drawn generally by displaying the three primary colors of RGB (red, blue and green) at the same time. In the case where the moving image blur offset period Ta and the moving image blur time Tb are different for each of R, G and B, therefore, the edge portion of the image changing from the previous-frame to the present frame may appear in a different color.

In the case where the previous-frame and the present frame are totally different in color, the edge coloring is not conspicuous. In the case where only the saturation (brightness) of the color in the same color group changes, however, the edge portions of the previous-frame and the present frame are colored with different colors conspicuously, thereby tending to develop the sense of incongruence.

An example is shown in FIGS. 11A, 11B. Consider a case in which a box area having the relative brightness values (0.96, 0.31, 0.23) as (R, G, B) is displayed on the background area having the relative brightness values (0.08, 0.02, 0.00) as (R, G, B) and scrolled from right to left on the screen. In this case, the expression (R, G, B)=(0.08, 0.02, 0.00) corresponds to dark brown, and the expression (R, G, B)=(0.96, 0.31, 0.23) corresponds to flesh color.

Ideally, the edge portions of the background area and the box on display are not blurred as shown in FIG. 11A. In the actual image, however, as shown in FIG. 11B, the left edge is observed as colored in gray and the right edge colored in red due to the difference of the moving image blur offset period Ta and the moving image blur time Tb among R, G and B.

In view of the fact that the background area and the box area are both reddish, the right edge is not conspicuous. The left edge, on the other hand, appears to lack the saturation against the background area and the box area, and therefore, is observed as colored in a complementary color conspicuously. This is also true in the case where the box area is scrolled from left to right or vertically.

The object of this invention is to provide a device and a method in which the moving image blur can be reduced and the edge portions of the blurred moving image are not colored in a complementary color, thereby realizing the moving image display free of the sense of incongruence.

The edge coloring is conspicuous in the case where the brightness of a color in the same color group changes with the transfer from the previous-frame to the present frame and the edge area is observed like a complementary color. In such a case, according to this invention, the video data of only a specified color is delayed by one frame time. As a result, the edge area can be displayed as if the saturation is improved in the same color group, and the edge coloring becomes less conspicuous.

Thus, in the hold-type display device, the moving image blur can be reduced, and the edge portion of the blurred moving image is not colored like a complementary color, thereby making it possible to realize a moving image display free of the sense of incongruence.

Especially in the hold-type display device such as the liquid crystal display, the phenomenon in which the edge of the same color group is colored in a different color can be prevented by correcting the edge portion of the moving image for each of R, G and B.

Other objects, features and advantages of the invention will become apparent from the following description of the embodiments of the invention taken in conjunction with the accompanying drawings.

BRIEF DESCRIPTION OF THE DRAWINGS

FIGS. 5A and 5B are diagrams showing the selection in the arithmetic circuit 407.

FIGS. 9A and 9B are diagrams showing the brightness response waveforms, in which FIG. 9A shows the instantaneous brightness response waveform and FIG. 9B shows the visual brightness response waveform.

FIG. 10A shows the moving image blur offset period Ta, and FIG. 10B the moving image blur time Tb.

DESCRIPTION OF THE EMBODIMENTS

The hold-type display device according to this invention includes a frame memory for holding a screen of video data for one frame period, and an arithmetic circuit for comparing the video data delayed by one frame with the video data of the present frame. Based on the result of comparison in the arithmetic circuit, the video data of one color or two is delayed by one frame period and displayed in the case where all the three primary colors of light change in the direction higher in brightness and the relative brightness of the video data of one color or two changes within the range between 0 and 0.5 inclusive.

An embodiment of the invention is explained below with reference to FIGS. 1 to 8.

Figure 1:
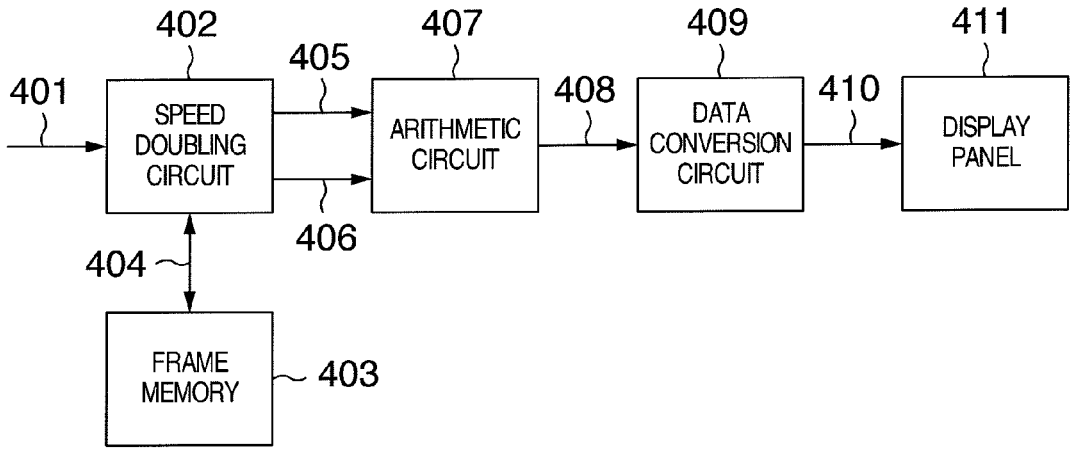
FIG. 1 is a diagram showing the configuration of the display device according to this invention.

FIG. 1 is a diagram showing the configuration of this embodiment. In this embodiment, the input frame frequency is assumed to be 60 Hz (=16.6 ms). Reference numeral 401 designates video data input from an external system, numeral 402 a speed doubling circuit, numeral 403 a frame memory, and numeral 404 an interface bus for executing the read/write process of the video data doubled in speed between the speed doubling circuit 402 and the frame memory 403. Numeral 405 designates the present-frame video data doubled in frame frequency, numeral 406 the previous-frame video data delayed by one frame period from the present-frame video data 405, numeral 407 an arithmetic circuit, numeral 408 the video data generated in the arithmetic circuit, numeral 409 the data conversion circuit, numeral 410 an output video data converted by the data conversion circuit, and numeral 411 a hold-type display panel.

Figure 2:
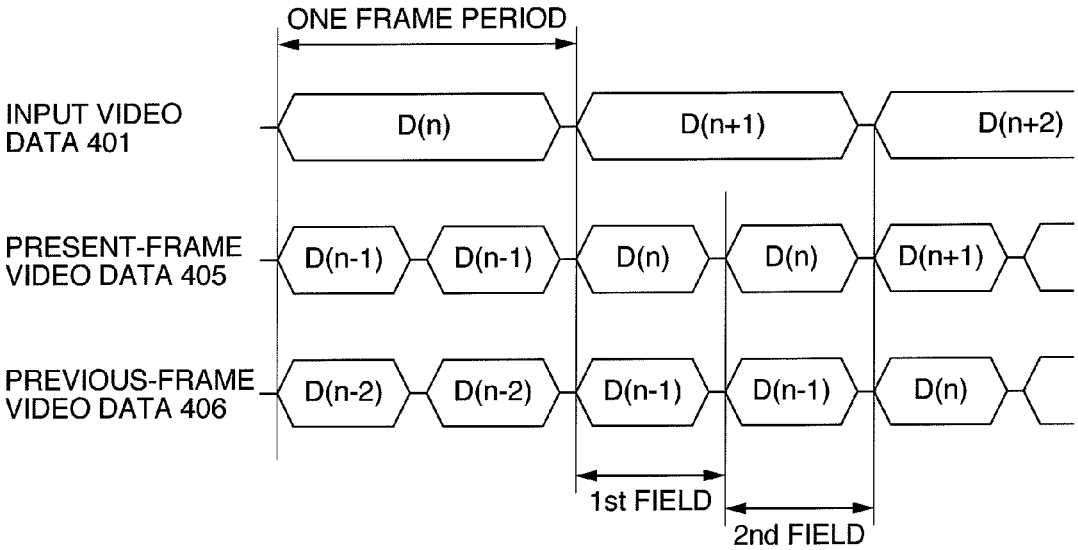
FIG. 2 is a timing chart showing the relation between the input video data 401, the present-frame video data 405 and the previous-frame video data 406.

FIG. 2 is a timing chart showing the relation between the input video data 401, the present-frame video data 405 and the previous-frame video data 406.

Figure 3:
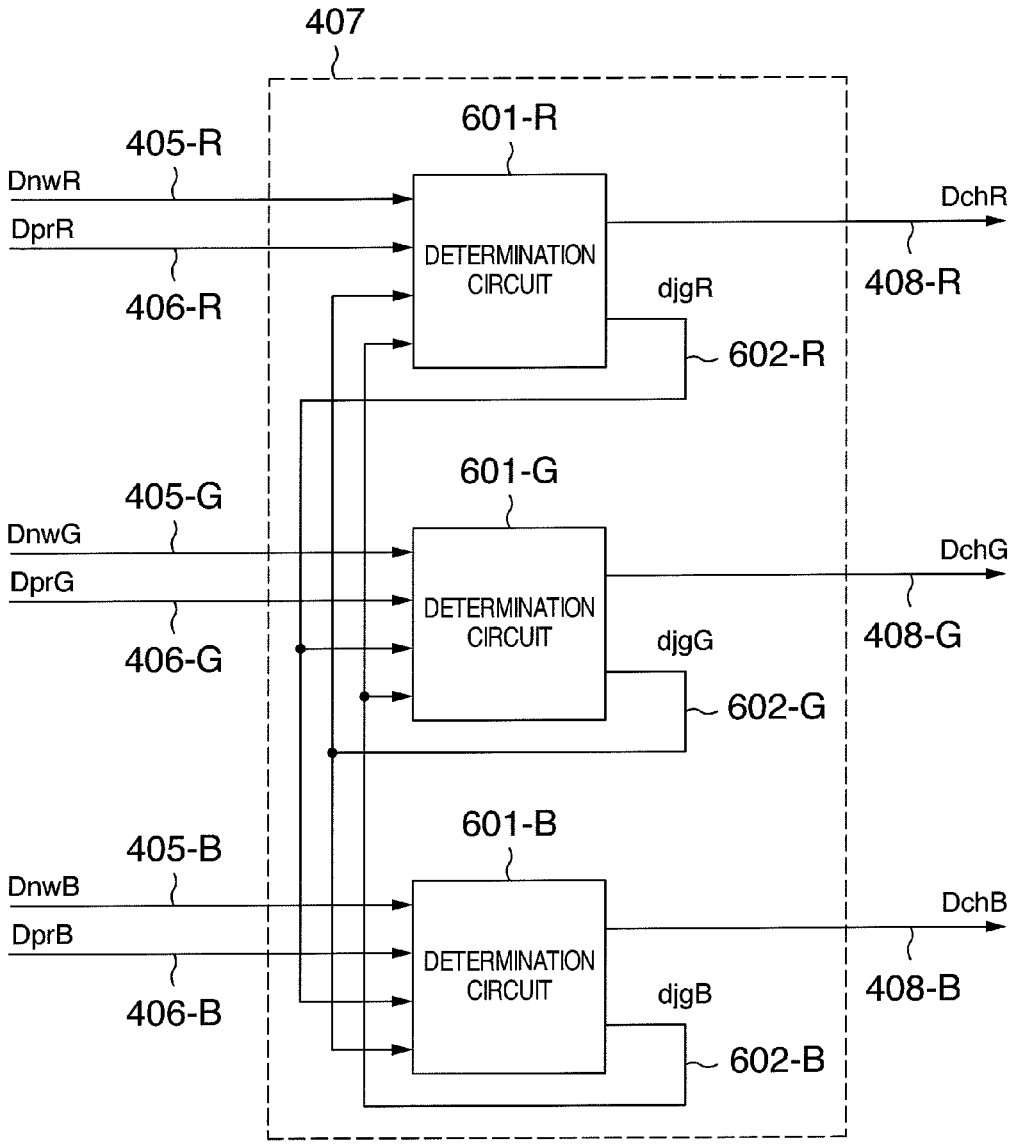
FIG. 3 is a diagram showing the configuration of the arithmetic circuit 407 shown in FIG. 1.

FIG. 3 is a diagram showing the configuration of the arithmetic circuit 407. In the description below, characters R, G and B attached indicate the colors of red, green and blue, respectively. Characters 405-R, G, B, 406-R, G, B and 408-R, G, B designate the component elements of the present-frame video data 405, the previous-frame video data 406 and the video data 408, respectively. Characters 601-R, G, B designate determining circuits for the respective colors, and characters 602-R, G, B determination signals for the respective colors. Character X attached designates each color of RGB. Thus, the present-frame video data 405 is referred to as DnwX, the previous-frame video data 406 as DprX, the video data 408 as DchX, and the determination signal 602 as digX.

Figures 4A, 4B:
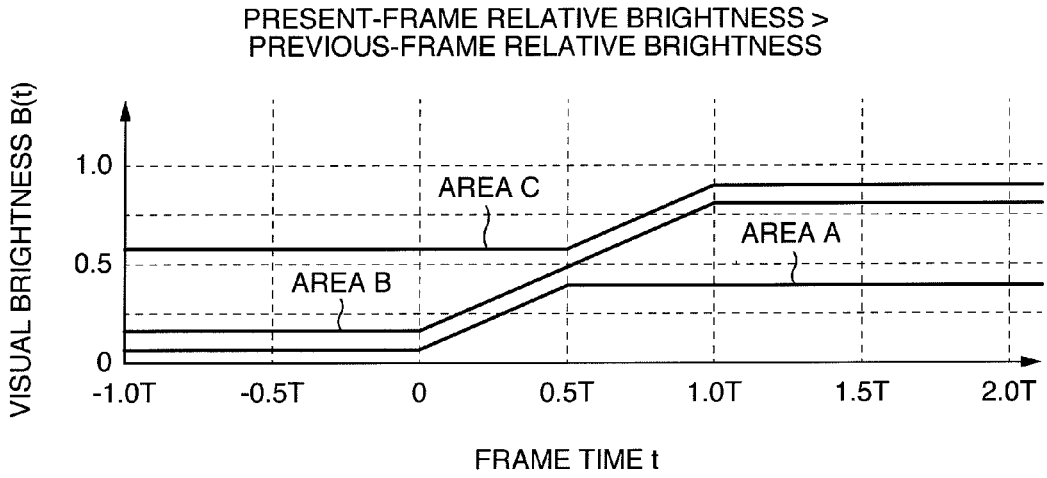
FIGS. 4A and 4B are diagrams showing the blurred areas of the moving image.

FIG. 4A is a diagram showing the moving image blur areas A, B, C to indicate that the moving image blur offset period Ta and the moving image blur time Tb shown in FIG. 10 can be divided into three areas. FIG. 4B is a diagram showing the chronological change of the visual brightness of the areas A, B, C in the case where the present-frame relative brightness is higher (brighter) than the previous-frame relative brightness.

The arithmetic circuit 407 includes the determination circuits 601-R, 601-G, 601-B for respective colors as shown in FIG. 3. Red is the self color for the determination circuit 601-R. Green is the self color for the determination circuit 601-G. Blue is the self color for the determination circuit 601-B. FIG. 5A shows which one of the present-frame video data DnwX (X is one of R, G and B and the self color) and the previous-frame video data DprX is selected in accordance with the state of the self color, the first other color and the second other color in the arithmetic circuit 407 when the relative brightness of the present-frame video data DnwX is higher than the relative brightness of the previous-frame video data DprX. FIG. 5B shows a case in which the present-frame video data DnwX is selected in cases other than FIG. 5A.

Figure 6:
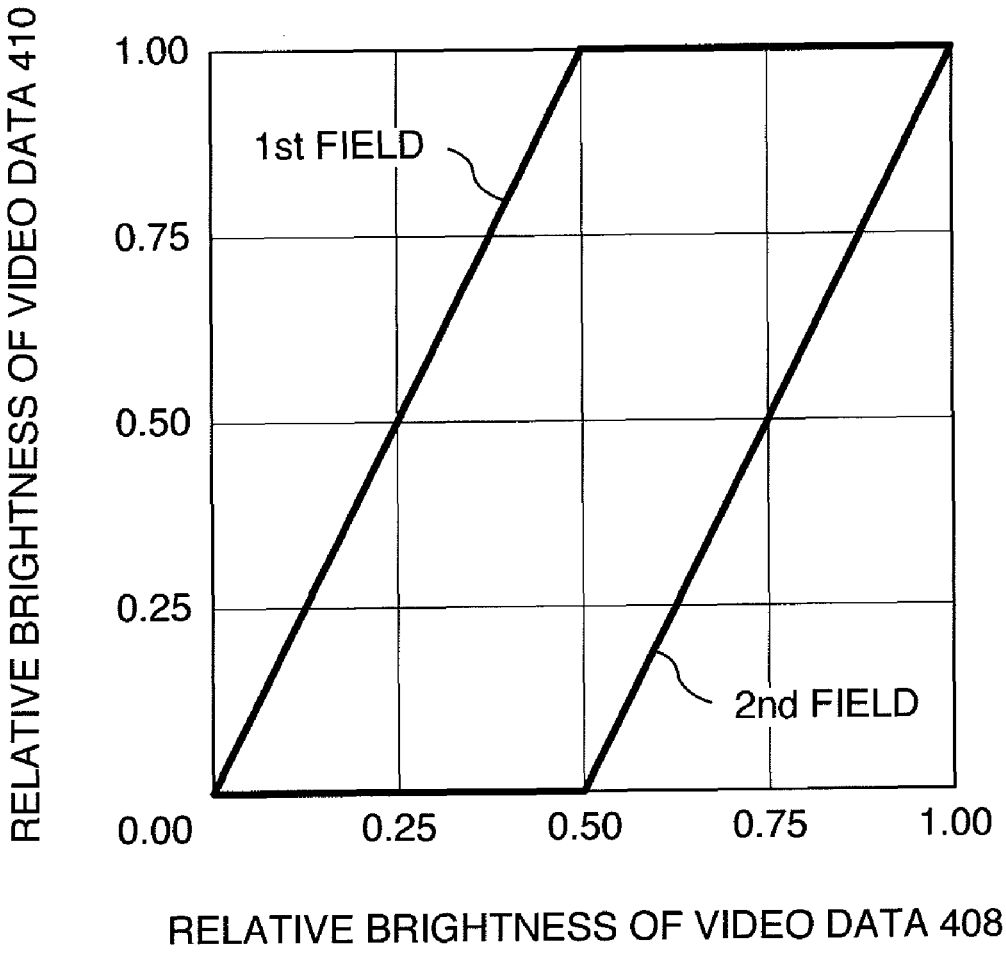
FIG. 6 is a diagram showing the input/output relation of the video data of the data conversion circuit 409 shown in FIG. 1.

FIG. 6 is a diagram showing the relation between the video data 408 input to the data conversion circuit 409 and the output video data 410. In FIG. 6, the video data 408 having the relative brightness of 0.5 is converted to have the relative brightness of 1.0 in the first field and to have the relative brightness of 0 in the second field.

Figure 7A:
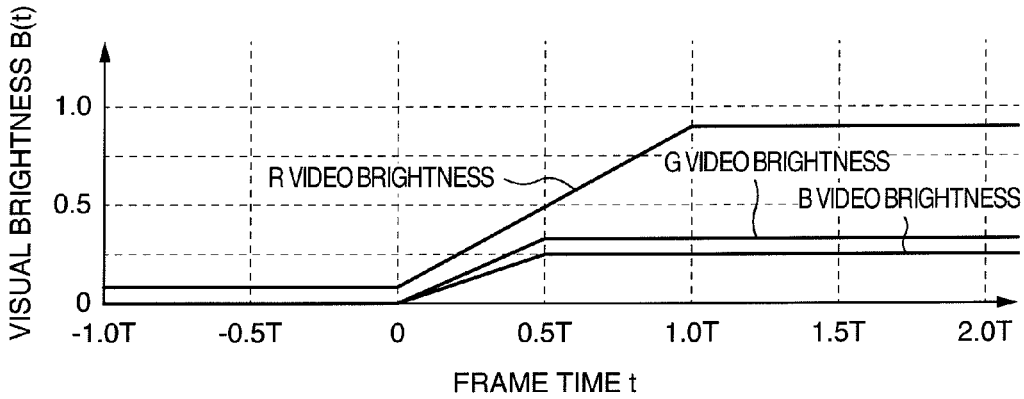
FIGS. 7A and 7B are diagrams showing the moving image blur of the left edge area in FIG. 11.
Figure 7B:
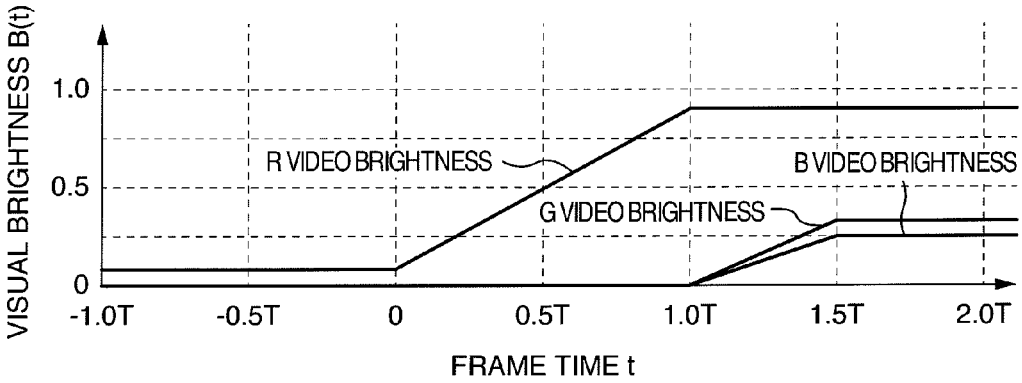
Figure 11A:
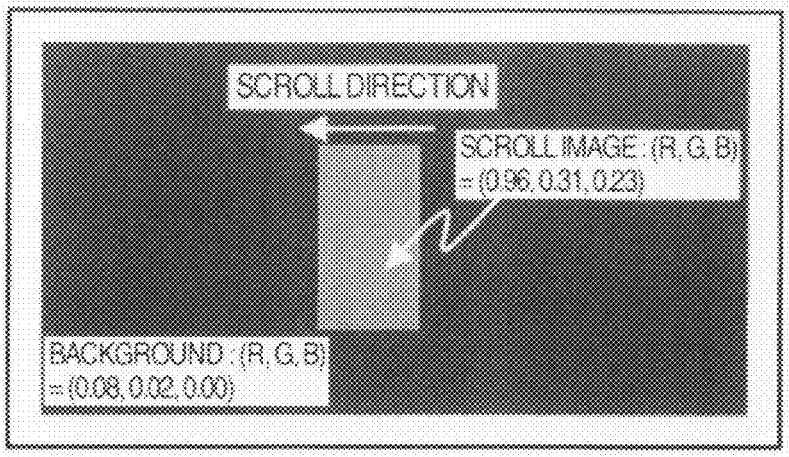
FIGS. 11A and 11B are diagrams showing the coloring phenomenon of the edges of the moving image.
Figure 11B:
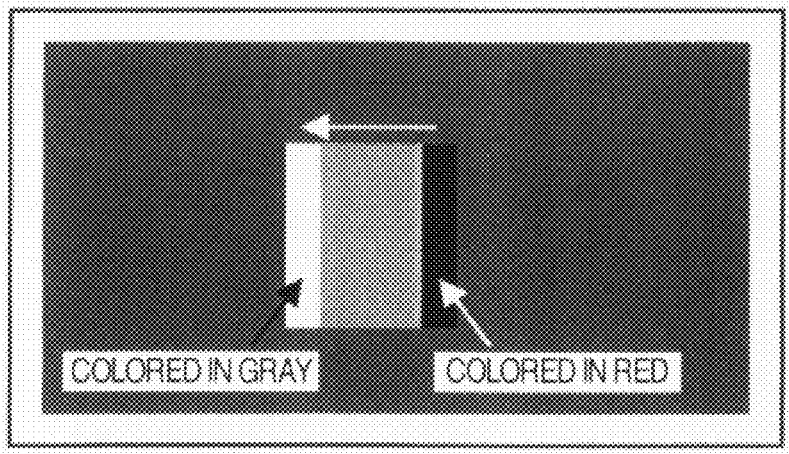

FIGS. 7A and 7B show the visual brightness waveform for each of R, G and B at the left edge portion of the scroll image shown in FIG. 11, in which FIG. 7A shows the conventional case and FIG. 7B the present invention.

Figure 8A:
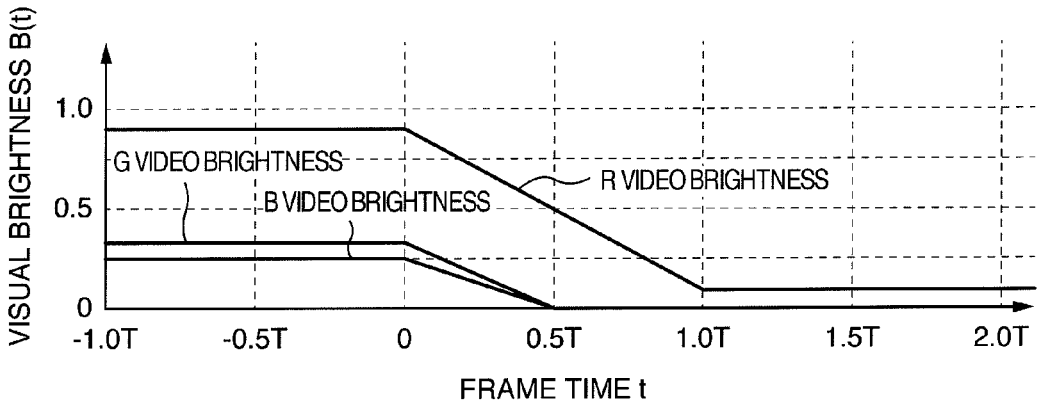
FIGS. 8A and 8B are diagrams showing the moving image blur of the right edge area in FIG. 11.
Figure 8B:
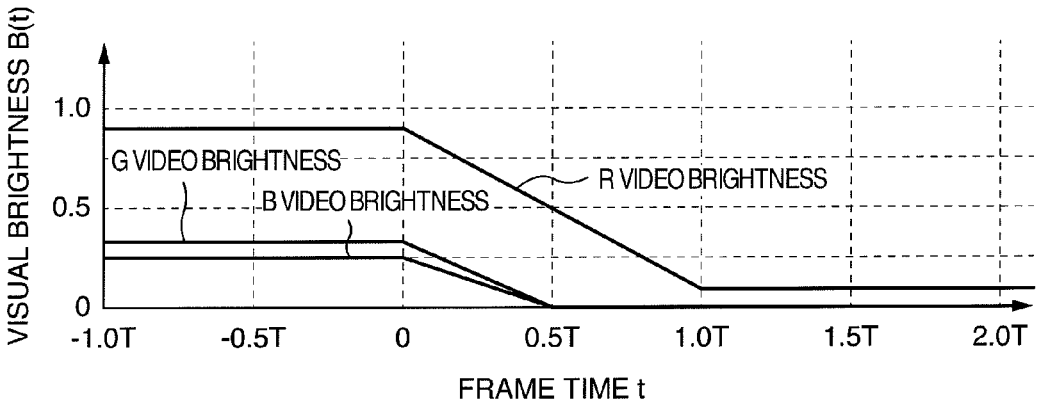
Figure 9A:
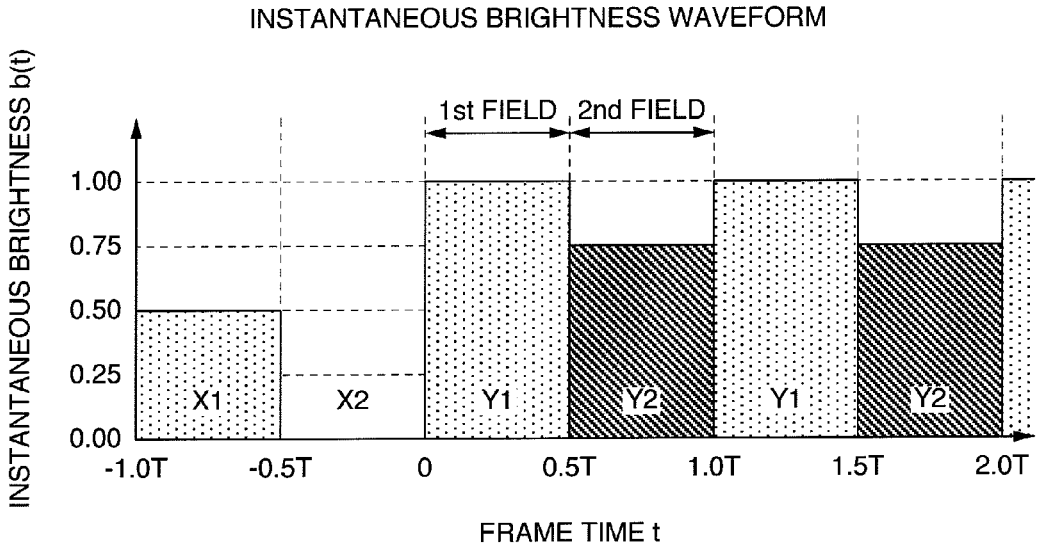
Figure 9B:
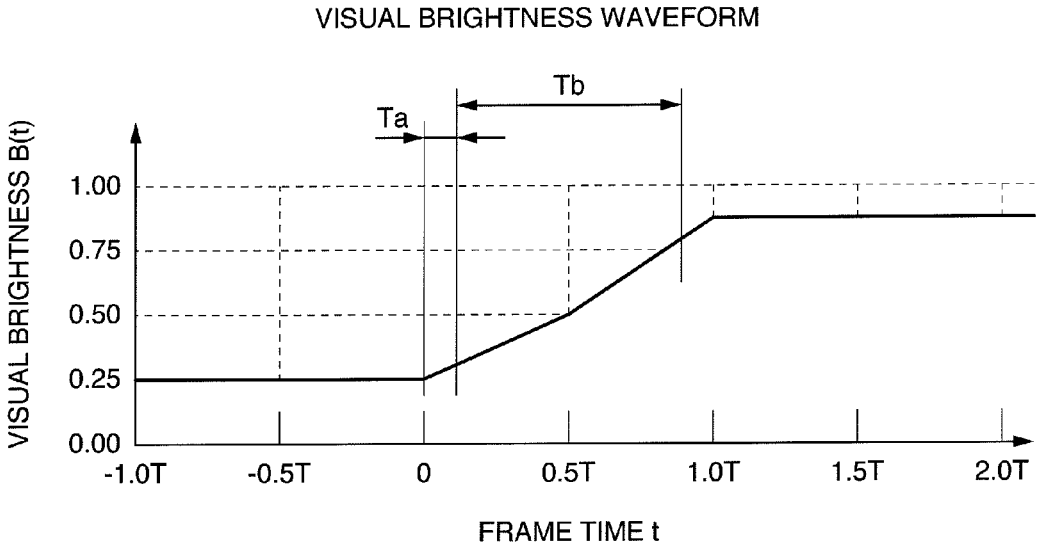

FIGS. 8A and 8B, similar to FIGS. 7A and 7B, show the visual brightness waveform for each of R, G and B at the right edge portion of the scroll image shown in FIG. 11, in which FIG. 8A shows the conventional case and FIG. 8B the present invention. The right edge portion is processed in this invention in the same way as in the conventional case.

Based on FIGS. 1 to 8, the operation of this embodiment is explained in detail.

In FIG. 1, the video data 401 is input from an external system. Assume that the video data 401 for one screen in the nth frame is D(n), as shown in FIG. 2. The video data for one frame is output twice at double frequency by the speed doubling circuit 402 and the frame memory 403. Thus, the present-frame video data 405 and the previous-frame video data 406 delayed by one frame time behind the present-frame video data 405 are generated. Of the two outputs of the same video data, the first video data is called the first field and the second video the second field.

The present-frame video data 405 and the previous-frame video data 406 generated in this way are input to the arithmetic circuit 407. In the arithmetic circuit 407, as shown in FIG. 3, the determination circuits 601 compare the present-frame video data 405 with the previous-frame video data 406 for each of R, G and B, and select the present-frame video data 405 or the previous-frame video data 406 based on the determination signals 602 for the self color and the other colors, to output the selected data as a video data 408.

Now, the conditions for determination are explained. In terms of the combination of the moving image blur offset period Ta and the moving image blur time Tb shown in FIGS. 10A and 10B, the area A is defined as a range in which Ta is not more than 0.5 and Tb not more than 0.5, the area B as a range in which Ta is not more than 0.5 and Tb more than 0.5, and the area C as a range in which Ta is more than 0.5 and Tb not more than 0.5, as shown in FIG. 4A.

In FIG. 4A, therefore, the area A is where the previous-frame relative brightness is between 0 and 0.5 inclusive while the present-frame relative brightness is between 0 and 0.5 inclusive, the area B is where the previous-frame relative brightness is between 0 and 0.5 inclusive while the present-frame relative brightness is more than 0.5 but not more than 1 or where the previous-frame relative brightness is more than 0.5 but not more than 1 while the present-frame relative brightness is between 0 and 0.5 inclusive, and the area C is where the previous-frame relative brightness is more than 0.5 but not more than 1 while the present-frame relative brightness is more than 0.5 but not more than 1.

In the case where the brightness changes toward a higher relative brightness of the RGB video data, ten combinations including No. 1 to No. 10 are formed as shown in FIG. 5A.

In FIG. 5A, No. 1 represents a case in which the three colors RGB including the self color, first and second other colors are all in the range of the area A. In this case, assume that the determination circuit 601 corresponding to the self color is the determination circuit 601-R, for example. The determination signal 602-R of the determination circuit 601-R of the self color indicates the area A, and the determination signals 602-G, 602-B of the determination circuits 601-G, 601-B of the first and second other colors also indicate the area A. Thus, the present-frame video data DnwR is selected as an output image data DchR.

Nos. 2 to 6, on the other hand, represent a case in which the self color and at most one other color of RGB are in the range of the area A and the remaining other color(s) in the range of the area B or C other than the area A. In this case, assume that the determination circuit 601 corresponding to the self color is the determination circuit 601-R, for example. The determination signal 602-R of the determination circuit 601-R of the self color indicates the area A, and at least one of the determination signals 602-G, 602-B of the determination circuits 601-G, 601-B of the first and second other colors indicates other than the area A. Thus, the previous-frame video data DprR is selected as an output image data DchR.

Also, Nos. 7 to 10 represent a case in which none of the three colors RGB is in the range of the area A. In this case, assume that the determination circuit 601 corresponding to the self color is the determination circuit 601-R, for example. The determination signal 602-R of the determination circuit 601-R of the self color indicates other than the area A, and the determination signals 602-G, 602-B of the determination circuits 601-G, 601-B of the first and second other colors also indicate other than the area A. Thus, the present-frame video data DnwR is selected as an output image data DchR.

In the cases other than shown in FIG. 5A, as shown in FIG. 5B, the present-frame video data DnwX is selected as an output image data DchX.

The edges are colored conspicuously in the case where the area A is included. Thus, in the case of Nos. 2 to 6 where the self color is in the area A and the other colors in the area B or C, the previous-frame video data DprX delayed by one frame period is selected as an output video data DchX, and the present-frame video data DnwX is selected in the other cases.

The video data DchX (408) thus selected is processed in the data conversion circuit 409 in such a manner that as shown in FIG. 6, the low relative brightness is expanded and the high relative brightness is compressed in the first field, while the low relative brightness is compressed and the high relative brightness is expanded in the second field. The video data 408 converted in this way is displayed on the display panel 411.

In the operation described above, the edge portions of the scroll image shown in FIG. 11A change as shown in FIGS. 7 and 8. In FIG. 11A, (R, G, B) changes from (0.08, 0.02, 0.00) to (0.96, 0.31, 0.23) at the left edge, and therefore, the brightness of all the RGB increase. Further, as classified according to the areas shown in FIG. 4, (R, G, B) changes to (area B, area A, area A). Thus, No. 2 shown in FIG. 5A is involved.

In this case, the arithmetic circuit 407 selects the signals delayed by one frame for G and B. As shown in FIG. 7B, therefore, the moving image blur offset time for G and B are delayed just by one frame as compared with the prior art.

As a result, the edge thus far colored in gray first changes in R, followed by the change in G and B, so that the background area and the box area scrolled are colored red in the same color group. Therefore, the edge coloring becomes less conspicuous. At the right edge, on the other hand, all of R, G and B fall, resulting in the case shown in FIG. 5B. This remains unchanged from the prior art. In this case, however, no problem is posed since the background area and the box area scrolled are originally colored red in the same color group.

According to this invention, the data conversion circuit 409 converts the first field to a brighter state and the second field to a darker state as shown in FIG. 6. In the conversion to darken the first field and brighten the second field, however, the areas A and C are replaced with each other in arrangement. As a result, the edge coloring of the scroll image is reversed between left and right sides in FIG. 11. Even in that case, the edge coloring can be suppressed at substantially the same level by delaying the video data in the range of the area A by one frame period in the case where the range corresponding to the area A, i.e. the area where the previous-frame relative brightness is between 0.5 and 1 inclusive and the present-frame relative brightness is between 0.5 and 1 inclusive has at most two of the three colors RGB and the brightness of all of the RGB fall.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device for displaying the color video data of one frame period divided into a first field period and a second field period, comprising:

an arithmetic circuit which, (1) in a first case that relative brightness of the video data of three primary colors in a present frame period is higher than relative brightness of the video data of the three primary colors in a previous frame period and the relative brightness of the video data of at least one and at most two primary colors of the three primary colors is in a range between a minimum brightness and a predetermined intermediate brightness inclusive in the previous frame period and the present frame period, outputs the video data of the at least one and at most two primary colors of the three primary colors in the relative brightness range for the previous frame period and outputs the video data of at least one remaining primary color of the three primary colors for the present frame period, and (2) in a second case other than the first case, outputs the video data of the three primary colors in the present frame period.

2. The display device according to claim 1, wherein the arithmetic circuit includes determining circuits for the three primary colors to compare the three-color video data for the present frame period with the three-color video data for the previous frame period to determine the relative brightnesses of the video data of the at least one and at most two primary colors in the present frame period and the previous frame period.

3. The display device according to claim 1, wherein the video data for the present frame period and the video data for the previous frame period are output from a speed doubling circuit for writing the input video data into a frame memory at double speed and reading the video data from the frame memory at double speed.

4. The display device according to claim 1, comprising a data conversion circuit wherein the relative brightness, in the first field period, of the video data selected by the arithmetic circuit is converted upward and the relative brightness thereof in the second field period is converted downward.

5. The display device according to claim 4, wherein the output video data converted in the data conversion circuit is displayed on a display panel.

6. The display device according to claim 1, wherein the predetermined intermediate relative brightness is 0.5 where the minimum relative brightness is 0 and the maximum relative brightness is 1.

7. The display device according to claim 1, wherein the previous frame period is the frame period immediately prior to the present frame period.

* * * * *